United States Patent [19]

Demmers

[11] 4,237,688

[45] Dec. 9, 1980

[54] HYDRAULIC SYNCHRONOUS DRIVING MECHANISM

[75] Inventor: Arie A. Demmers, Alblasserdam, Netherlands

[73] Assignee: Koninklijke Bos Kalis Westminster Group N.V., Sliedrecht, Netherlands

[21] Appl. No.: 42,603

[22] Filed: May 23, 1979

[30] Foreign Application Priority Data

May 30, 1978 [NL] Netherlands ..... 7805880

[51] Int. Cl.[3] ..... F15B 13/02

[52] U.S. Cl. ..... 60/484; 60/486; 91/512

[58] Field of Search ..... 60/484, 486; 91/170 R, 91/515, 520, 512

[56] References Cited

U.S. PATENT DOCUMENTS

B 584,520 1/1976 Rice ..... 60/484 X 4,034,649 7/1977 Harvey et al. ..... 60/484

*Primary Examiner*—Irwin C. Cohen

*Attorney, Agent, or Firm*—Cushman, Darby & Cushman

[57] ABSTRACT

A hydraulic synchronous driving mechanism provided with at least two piston-cylinder assemblies, each having a bottom chamber and a ring chamber and the piston rods of which engage a counterdevice adapted to synchronously load piston rods mutually in opposite directions, a hydraulic fluid circuit provided with at least a pump and a reservoir, whereby there are pair-wise arranged volumetric pump-motors in fluid lines throughconnected to the bottom chamber of the one cylinder and the ring chamber of the other cylinder, which pump-motors are mutually coupled for a constant supply ratio, while the fluid line sections extending from the pump-motors to the cylinders are throughconnected to only one cylinder chamber.

5 Claims, 3 Drawing Figures

HYDRAULIC SYNCHRONOUS DRIVING MECHANISM

The invention relates to a hydraulic synchronous driving mechanism provided with at least two piston-cylinder assemblies, each having a bottom chamber and a ring chamber, the piston rods of which project from the ring chambers while engaging a counter-device adapted to load the piston rods synchronously mutually in opposite directions, a hydraulic fluid circuit provided with at least a pump and a storage reservoir, whereby in fluid lines connected to the bottom chamber of the one cylinder and the ring chamber of the other cylinder, and reversely, pair-wise volumetric pump-motors are disposed which are interconnected for a constant through-flow rate.

In Dutch patent application No. 74,16509 laid open to public inspection there is described a driving mechanism of this type which is disposed on a dredging vessel for advancing same by means of a spud anchor construction which thereby forms the counter-device. The bottom wherein the spud anchor is inserted with the lower end, cannot provide the spud anchor with the required torque necessary for maintaining the spud anchor in vertical position when the reaction force acts on its top portion, which is produced during advancement of the vessel. The driving mechanism should therefore supply this torque to the spud anchor, viz. by means of the opposite load of the pistons keeping a vertical distance. Mainly with an elongate spud anchor substantial hydraulic forces and long piston travels are concerned here, so that considerable energy is concerned which for a major part is recovered in the above prior art apparatus by means of the volumetric pump motor coupled for a constant transmission ratio. This prior art synchronous driving mechanism, however, has the drawback that it is complicated and expensive. It is the object of the invention to eliminate this drawback.

The above described hydraulic synchronous driving mechanism in the embodiment according to the invention is characterized in that the fluid line sections extending from the pump motor to the cylinders are throughconnected with only one cylinder chamber. The maintenance of this particular feature brings several embodiments of a simple and effective hydraulic synchronous driving mechanism within reach, some examples of which are shown in the drawing.

The drawing diagrammatically shows in

FIG. 1 a first embodiment of a driving mechanism according to the invention in a given operative condition;

Figure 1:
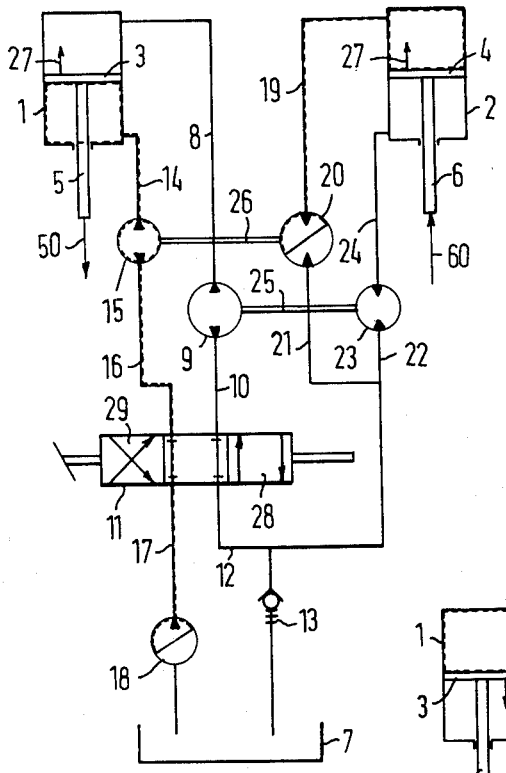

In the diagram of FIG. 1 are included two hydraulic cylinders 1 and 2, each provided with a piston 3 and 4, respectively, and having a piston rod 5 and 6, respectively, which pistons divide the cylinders in a bottom chamber and a ring chamber, through which the associated piston rod projects outwardly. The pistons, like the piston rods, mutually have the same cross-section. The bottom chamber of cylinder 1 is connected to the fluid reservoir 7 through a line, a part 8 of which is situated between the bottom chamber and a volumetric pump-motor 9, a portion 10 between said pump-motor and a pilot valve 11 and a portion 12 between said pilot valve and the reservoir 7. In the portion 12 there is incorporated a non-return valve 13. The ring chamber of cylinder 1 is connected via a line section 14 to the volumetric pump-motor 15 which is throughconnected by the line section 16 to the pilot valve 11, which in the drawn position of FIG. 1 throughconnects the line section 16 to the reservoir 7 via the line section 17 wherein a pump 18 is incorporated. The bottom chamber of cylinder 2 communicates via line section 19 to the volumetric pump-motor 20 which connects via line section 21 to the above mentioned line section 12. To the line section 12 is also connected the line section 22 which via the volumetric pump-motor 23 is adapted to communicate with the line section 24, which connects to the ring chamber of cylinder 2.

The pump-motors 9 and 23 are mechanically coupled to each other through a shaft 25, as well as the pump-motors 15 and 20 mutually by the shaft 26. These known per se pump-motors may operate as a pump pumping the hydraulic fluid and as a motor driven by the hydraulic fluid. The volume passed by these means is proportional to their speed. As a result the coupling of the pumpmotors 15 and 20 ensures through the shaft 26 a constant ratio between the quantities of fluid passing through the line sections 14 and 19 respectively in and out of the connected cylinder chambers. Since the pistons 3 and 4 have to move with the same displacement rate, the volumetric capacity per revolution of the pump-motors 15 and 20 has the same mutual ratio as the ratio between the surfaces of the free internal sections of respectively the ring chamber of cylinder 1 and the bottom chamber of cylinder 2. The same ratio applies to the volumetric capacities per revolution of respectively the pump-motors 23 and 9. The pump-motors of larger capacity, 9 and 20 are drawn accordingly in the drawing with a larger diameter than the other pump-motors 15 and 23.

In case equally dimensioned pump-motors are to be applied, a coupling may be interposed via a transmission device, such as a gear box, defining the drive ratio.

Allowance has been made for the mutually opposite flow directions in the line sections 14 and 19, as well as in line sections 24 and 8, by the choice of the apertures of the pump-motors where the line sections are connected.

In the diagram of FIG. 1 there is assumed an operative condition wherein the pistons 3 and 4 move synchronously in the direction of the arrows 27 while external forces 50, 60 act on the piston rods 5 and 6. The forces 50 and 60 act in mutually opposite directions and are of unequal magnitude, since a resultant should become available for achieving the contemplated result, such as the provision of drive force to a ship to be displaced. In conection with the direction of the arrows 27, the force 50 in FIG. 1 is assumed larger than the force 60.

In FIG. 1 the control valve 11 is assumed in the passage condition corresponding to the diagrammatic indication by the arrows 28. The pump 18 draws hydraulic fluid from the reservoir 7, pressing said fluid under pressure via the line section 17, the control valve 11 and the line section 16 into the hydraulic pump-motor 15 which likewise receives driving force from the hydraulic pump-motor 20 and hence pumping the fluid at further increased pressure via the line section 14 into the ring chamber of the cylinder 1. The pump-motor 20 is adapted to provide driving force to the pump-motor 15 in that it is driven itself by the fluid kept under high pressure through the force 60, which fluid subsequently flows through the line section 19 and via the pump-motor 20 into the line section 21, wherein only prevails the low pressure defined by the non-return valve 13. The valve 13 only serves for maintaining a minimum pressure A in the line system in order to exclude intrusion of air. By the supply of energy through the pump-motors 15 and 20 the energy to be supplied by the pump 18 remains restricted to the energy that is provided by the displacement force over the displacement path length resulting from the forces 50 and 60, increased by the normal frictional losses and the slight throttling loss which is produced in the throttle valve 13 wherein the fluid under low pressure flows back from the bottom of the cylinders 1 and 2 reduced by the quantity taken up by the ring sides of cylinder 1 and 2.

Figure 2:
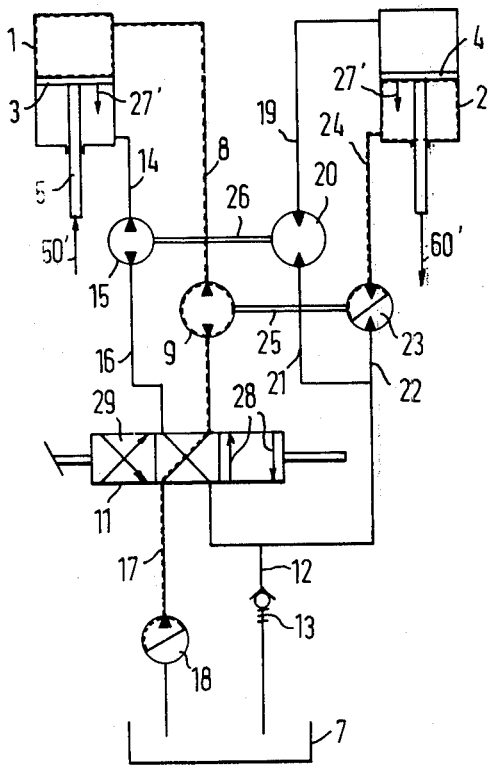
FIG. 2 shows the same embodiment in a different operative condition.

In FIG. 2 the mutually oppositely directed external forces are indicated respectively by 50' and 60', which are opposite to the forces 50 and 60, respectively in FIG. 1, while the displacement direction of the pistons indicated by 27' is opposite to the displacement direction of the pistons 3 and 4 indicated by 27 in FIG. 1. The control valve 11 in FIG. 2 is to this effect assumed in the passage position corresponding to diagrammatic indication by the crossed arrows 29. The fluid under high pressure now passes t the bottom chamber of cylinder 1, thereby pressurized by pump 18 and the hydraulic pump-motor 9, which is driven by the pump-motor 23 passing the pressure fluid from the ring chamber of cylinder 2 and driven thereby. The pair of pump-motors 15 and 20 has now only the task to maintain the constant ratio of the flow from and in respectively the ring chamber of cylinder 1 and the bottom chamber of cylinder 2. The operation of the apparatus in the condition shown in FIG. 2 furthermore can be deduced from what is discussed in connection with FIG. 1.

Figure 3:
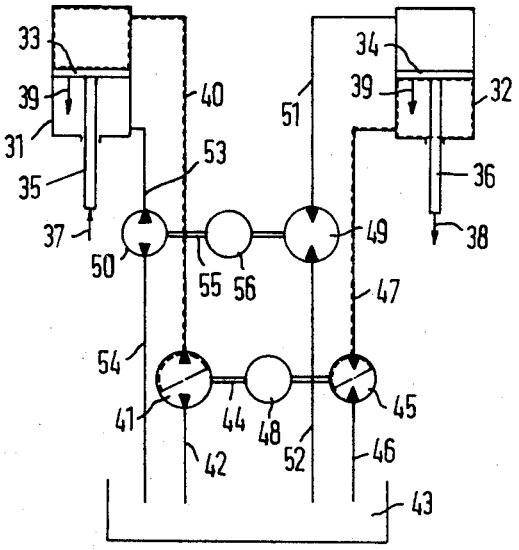
FIG. 3 shows a second embodiment.

For clearness' sake the line sections in FIGS. 1–3 wherein the higher pressures prevail have been doubled with dashed lines, while the chambers of the cylinders and the pump-motors, wherein the higher pressures prevail have a correspondingly doubled circumferential line.

In FIG. 3 the cylinders 31 and 32 are provided with pistons, respectively 33 and 34, which are connected to the outwardly extending piston rods, respectivly 35 and 36, on which the mutually opposite, unequal forces 37 and 38 act and whereby the pistons are moved in the direction of the two arrows 39.

Between the line sections 40 and 42, which connect the bottom side of cylinder 31 to the reservoir 43, there is incorporated a pump-motor 41 which for synchronous rotation is coupled by the shaft 44 to the pump-motor 45, which is mounted between the line sections 46 and 47 connecting the ring side of cylinder 32 to the reservoir 43. The shaft 44 is drivable by the motor 48 which, when not energized is adapted for free-rotation when one of the pump-motors is driven by the fluid. Correspondingly the bottom side of cylinder 32 and the ring side of cylinder 31 are connected to the reservoir 43 via pump-motors 49 and 50, disposed between respectively the pair of line sections 51 and 52 and a pair of line sections 53 and 54 between the reservoir and respectively the latter bottom and ring side. The pump-motors 49 and 50 are coupled by the shaft 55, which is drivable by the motor 56 which when non-energized as motor 48, is adapted for free-rotation.

For the piston displacement according to the arrows 39 the motor 48 is energized for driving the pump-motor 41, aided by the driving force derived by the pump-motor 45 from the fluid under high pressure in the ring chamber of cylinder 32.

The pump-motor 50 is driven by the fluid under low pressure flowing from the ring chamber of cylinder 31. The pump-motor 50 thereby drives the shaft 55, the non-energized motor 56 and the pump-motor 49 in rotation ensuring thereby the filling of the bottom side of cylinder 32.

Upon energization of the motor 56 and nonenergization of the motor 48 the displacement direction is reversed.

By the crossed coupling of the bottom and ring sides of the cylinders by means of the pair-wise coupled hydraulic pump-motors, the synchronization of the pistons is always ensured, irrespective of the directions of the external forces on the pistons.

The two pairs of pump-motors are coupled by the fluid to synchronously operating pairs.

Therefore shafts 44 and 55 and thereby all pump-motors can be driven by a single bidirectionally drivable motor, thereby achieving entirely the same operation. All pump-motors and the motor may be co-axially arranged for avoiding application of a gear box.

When unequal speed of the two pistons in specific ratio is desired, e.g. for imparting to an element, such as the above described spud anchor, likewise a tilting movement, this may be achieved by a specific choice of inequality of the volumetric capacity of the pump-motors and/or inequality of the section of pistons and piston rods.

Instead of two hydraulic cylinders, also two hydraulic motors may be utilized for effecting the required movement.

Furthermore the apparatus may also serve other applications than for a spud anchor system.

What I claim is:

1. A hydraulic synchronous driving mechanism provided with at least two piston-cylinder assemblies, each having a bottom chamber and a ring chamber and piston rods of which projecting from the ring chambers engage a counter-device adapted to synchronously load the piston rods mutually in opposite directions, a hydraulic fluid circuit provided with at least a pump and a storage reservoir, there being arranged pair-wise volumetric hydraulic pump-motors in fluid lines throughconnected to the bottom chamber of the one cylinder and the ring chamber of the other cylinder, and inversely, means mutually coupling said pump-motors in each pair for a constant supply ratio, characterised in that fluid line sections extending from the pump-motors to the cylinders are throughconnected with only one cylinder chamber.

2. A mechanism according to claim 1, characterised in that each of the said hydraulic pump-motors is adapted for being driven by the fluid pressure in the line, wherein it is incorporated, thereby providing driving power to the interconnected pump-motor incorporated in the other line of the line pair, and the fluid line sections which connect to the pump-motors being arranged for communication with the storage reservoir.

3. A mechanism according to claim 2, characterised in that in the fluid line sections adapted for communication with the storage reservoir, being sections of the fluid lines communicating respectively to the bottom and ring chamber of the same cylinder, there is incorporated a control valve by means of which one of said line sections can be selectively throughconnected to the pump supplying from the reservoir and the other for direct communication with the storage reservoir, and inversely.

4. A mechanism according to claim 2, characterised in that the said hydraulic pump motors are adapted for direct motor synchronous drive selectively in both directions and the line sections conducting fluid from the pump-motors to the storage reservoir communicate directly therewith.

5. A mechanism according to claim 4, characterised in that each pair of said hydraulic pump-motors constitute a single drivable unit.

* * * * *